United States Patent [19]

Heggeland et al.

[11] Patent Number: 4,491,231

[45] Date of Patent: Jan. 1, 1985

[54] COLLAPSIBLE CASE

[75] Inventors: Bruce Heggeland, Rolling Meadows; George Garcia, Chicago; Sam S. LoBosco, Glendale Heights, all of Ill.

[73] Assignee: Family Distributors, Inc., Glendale Heights, Ill.

[21] Appl. No.: 494,520

[22] Filed: May 13, 1983

[51] Int. Cl.[3] ..... B65D 6/18; B65D 21/02

[52] U.S. Cl. ..... 220/6; 206/509; 206/511; 220/7

[58] Field of Search ..... 220/617, 21; 206/509, 206/511, 512

[56] References Cited

U.S. PATENT DOCUMENTS

| | | | |
|---|---|---|---|
| 2,558,126 | 6/1951 | Davenport | 220/6 |
| 3,628,684 | 12/1971 | Sere | 220/21 |
| 3,762,594 | 10/1973 | Utz | 220/21 |
| 4,235,345 | 11/1980 | VandeDrink | 220/6 |
| 4,320,845 | 3/1982 | Waller | 220/6 |

FOREIGN PATENT DOCUMENTS

| | | | |
|---|---|---|---|
| 1494178 | 7/1967 | France | 220/6 |

*Primary Examiner*—George E. Lowrance
*Attorney, Agent, or Firm*—Anthony S. Zummer

[57] ABSTRACT

The present invention relates to an improved collapsible square case having a square open top and being particularly adapted for holding a plurality of items. The case includes a pair of opposed corner panels. Each of the corner panels has a flat side and a corner wall formed integral with one edge of the respective flat side being substantially perpendicular to the flat side. Each of said corner panels being an integral molded plastic panel. Said flat sides are parallel to each other. Said corner walls are parallel to each other. A pair of flat panels, each having one edge hingedly connected to a corner wall and the opposite edge connected to the edge of the flat side of the other corner panel. Each of the flat panels being an integral molded plastic part. A floor panel being an integral molded plastic part. Said floor panel being hingedly connected to the lower edge of a flat side of one of the corner panels. All of the panels being adapted to be subjected to high temperature and moisture to clean the panels. Raising of the floor panel adjacent to its respective flat side allows the case to collapse and placing hingedly connected flat panels in an attitude whereby each flat panel is in substantially the same plane as the respective flat side. A collapsed case may be stacked on top of another like collapsed case.

7 Claims, 24 Drawing Figures

FIG. 1
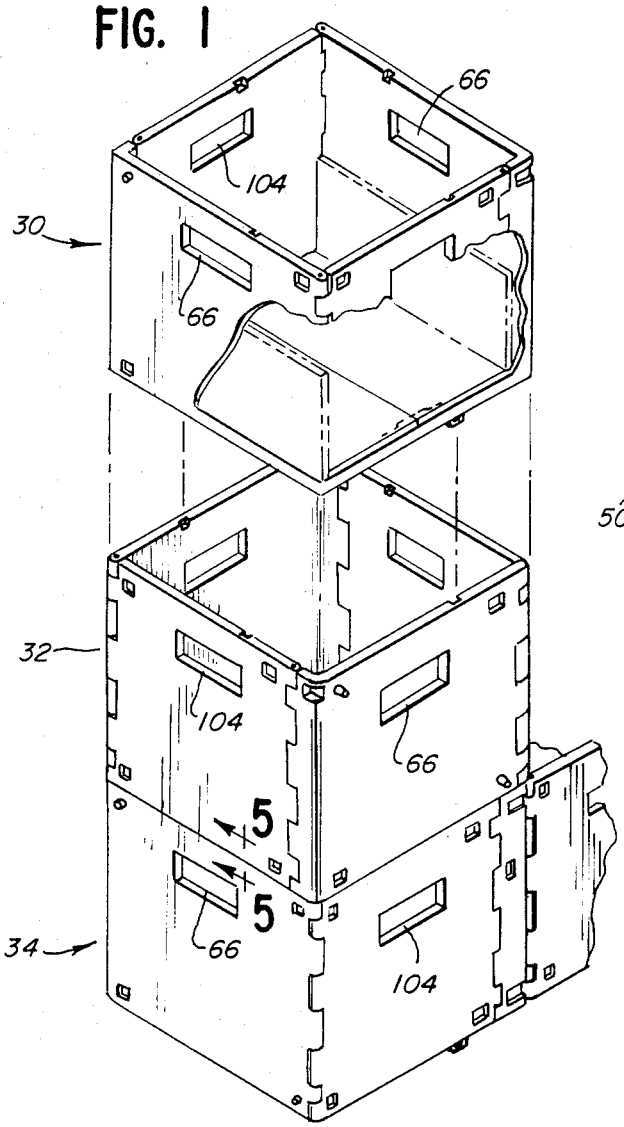
FIG. 2
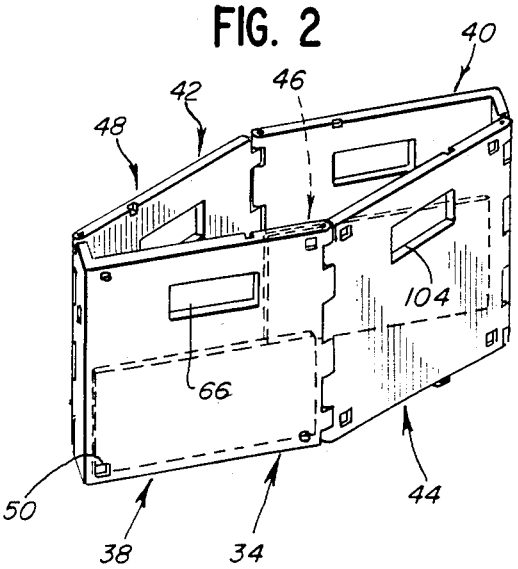
FIG. 3
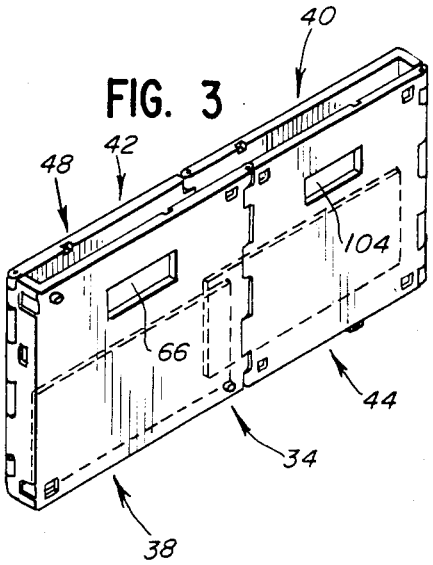
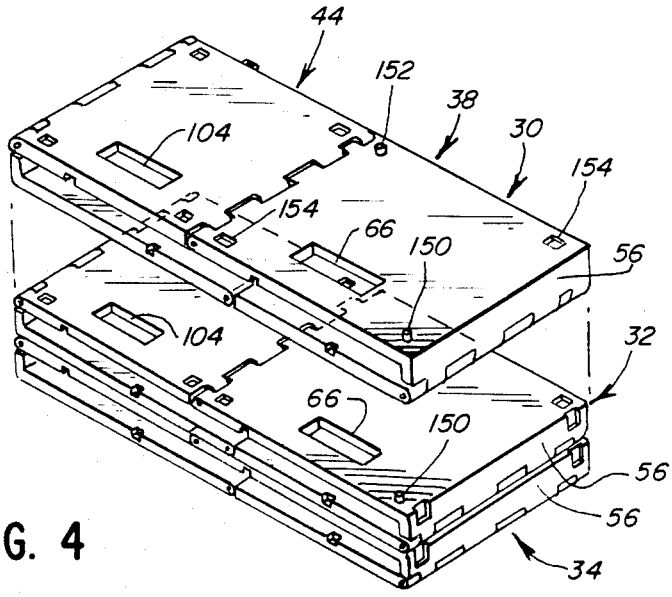
FIG. 4
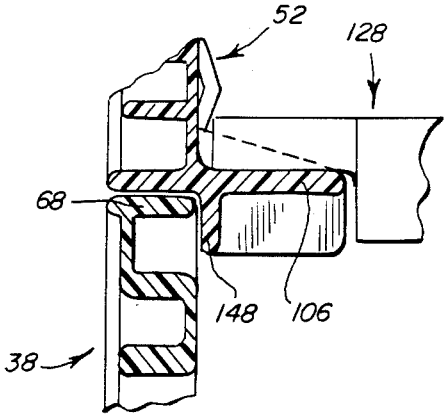
FIG. 5

FIG. 11
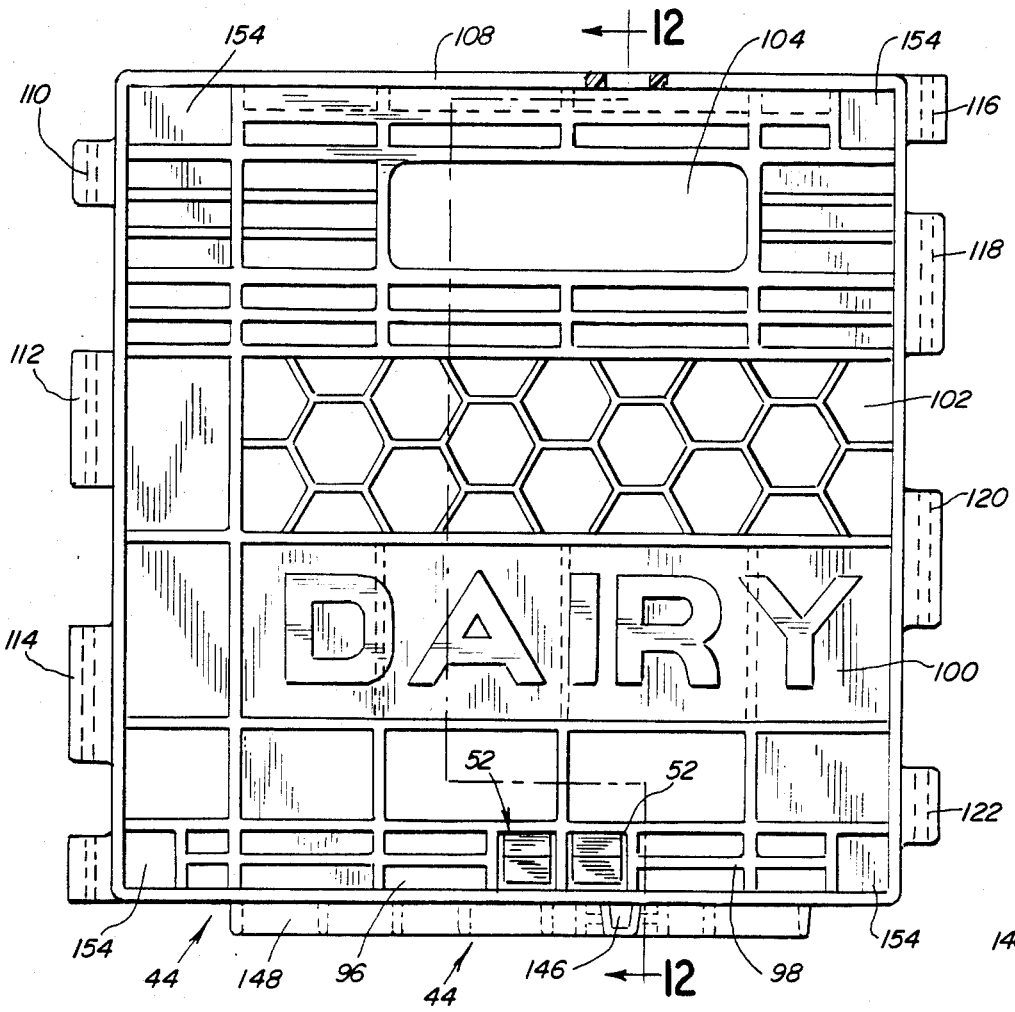
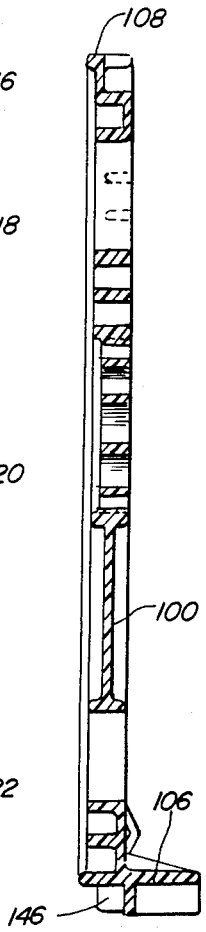
FIG. 12
FIG. 13
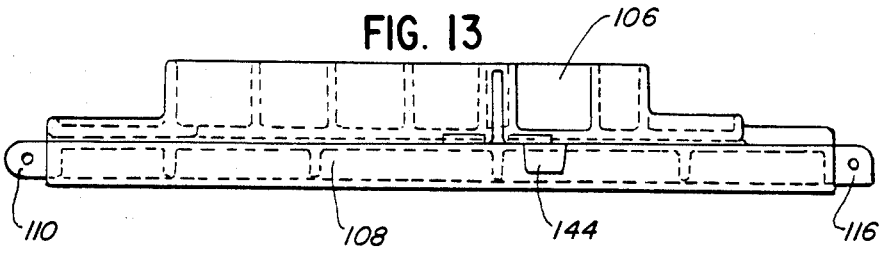

FIG. 14
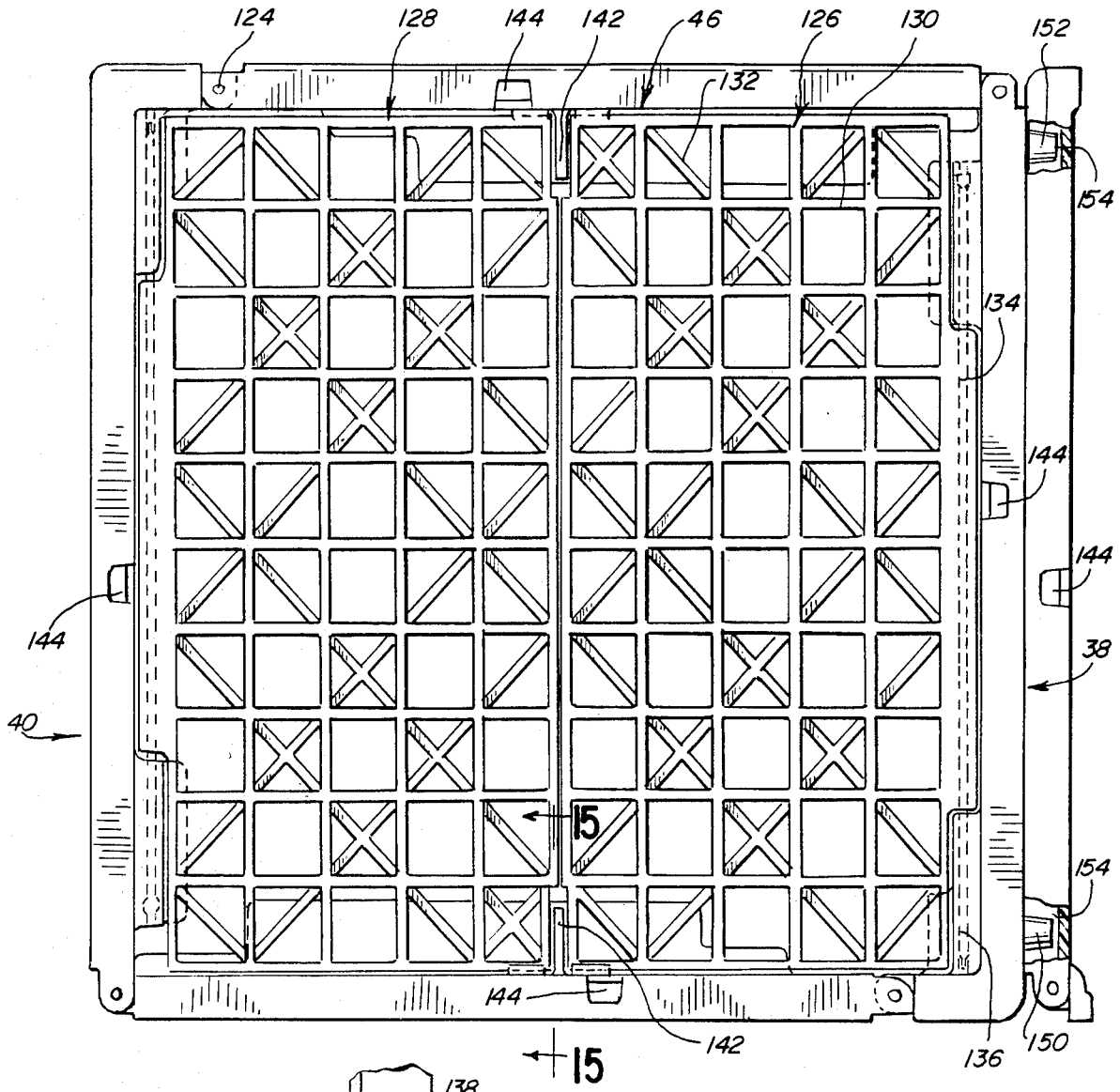
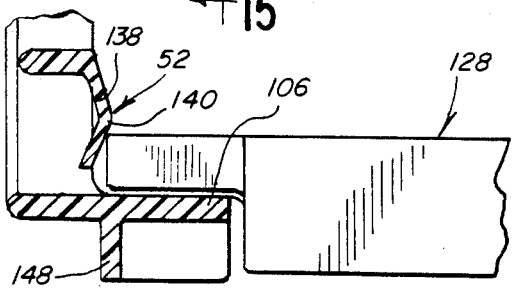
FIG. 15

FIG. 16
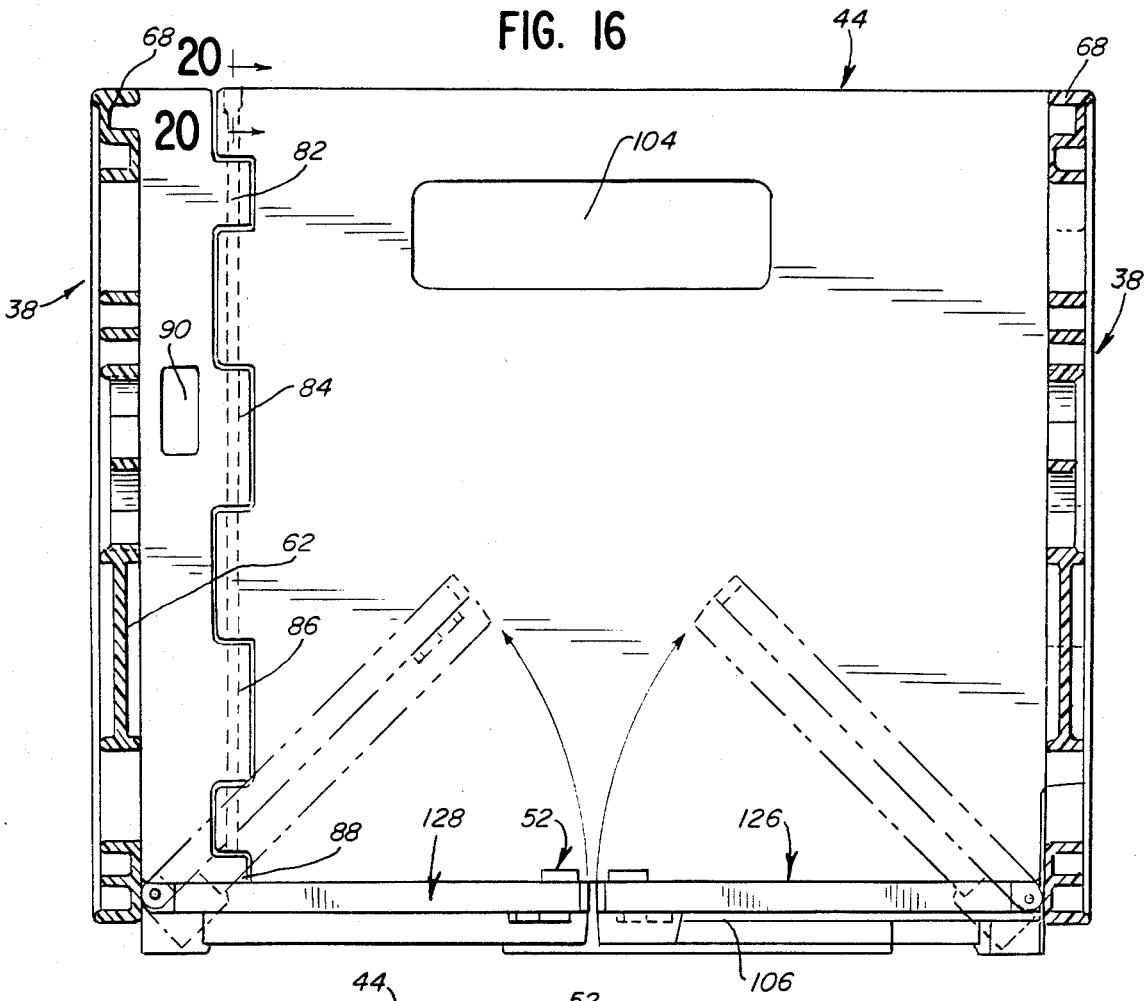
FIG. 17
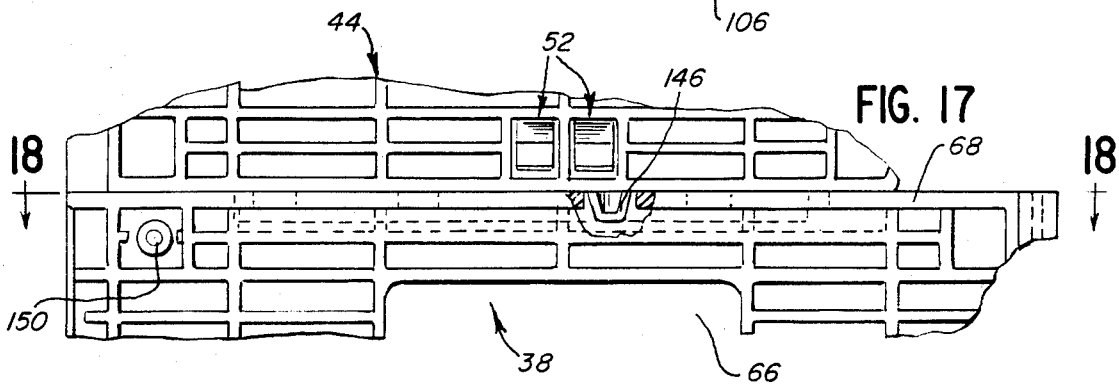
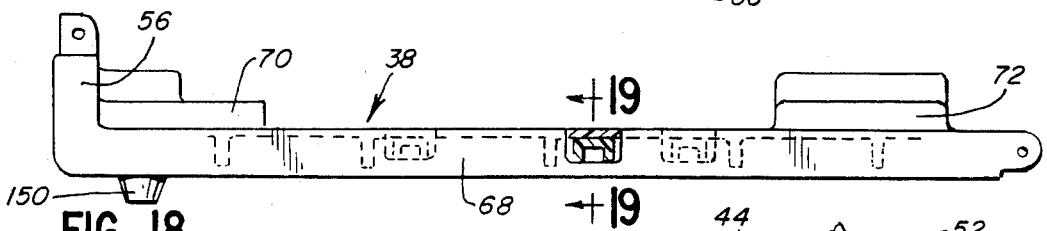
FIG. 18
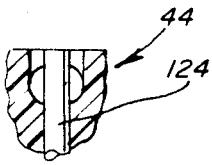
FIG. 20
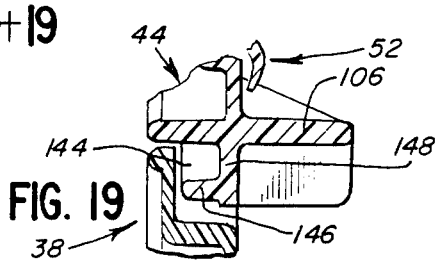
FIG. 19

FIG. 23
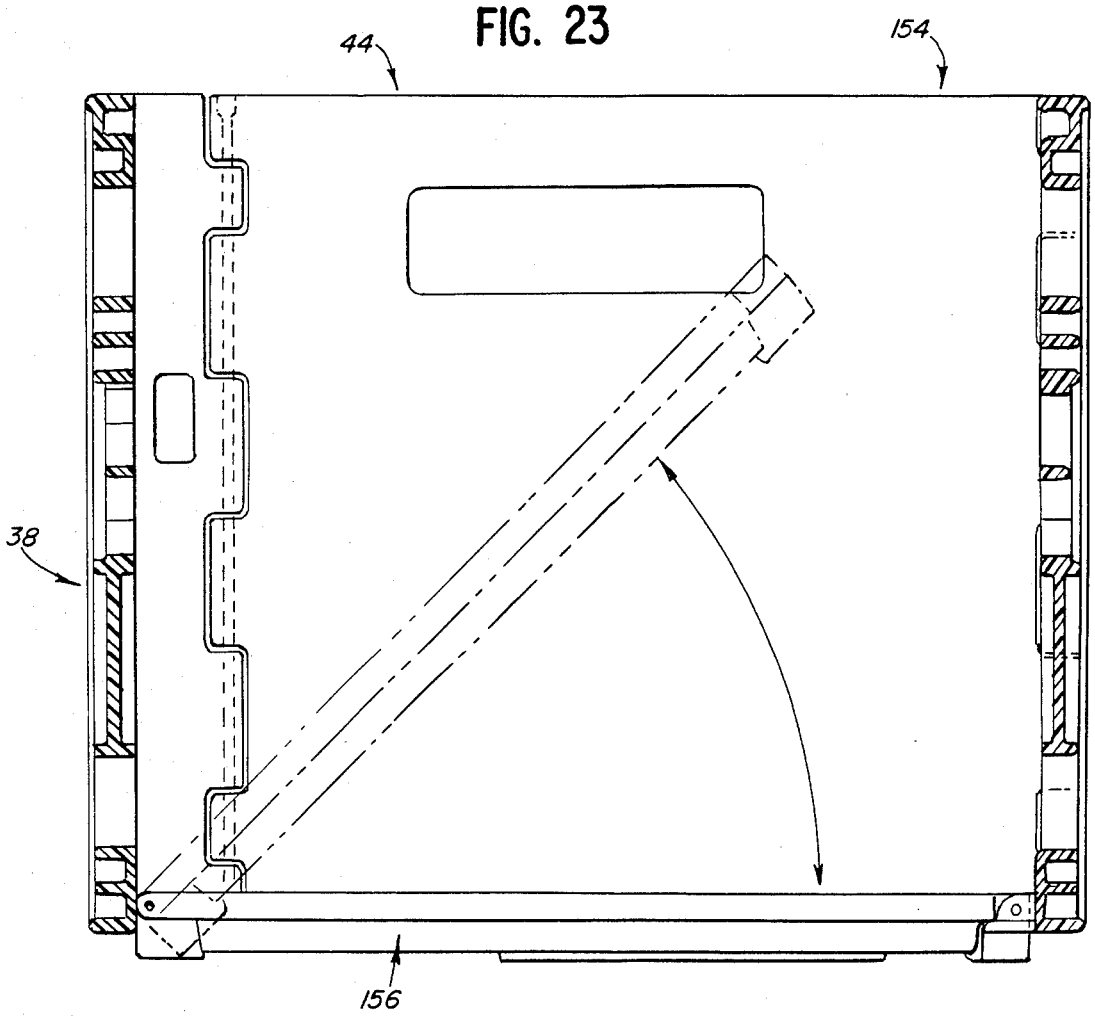
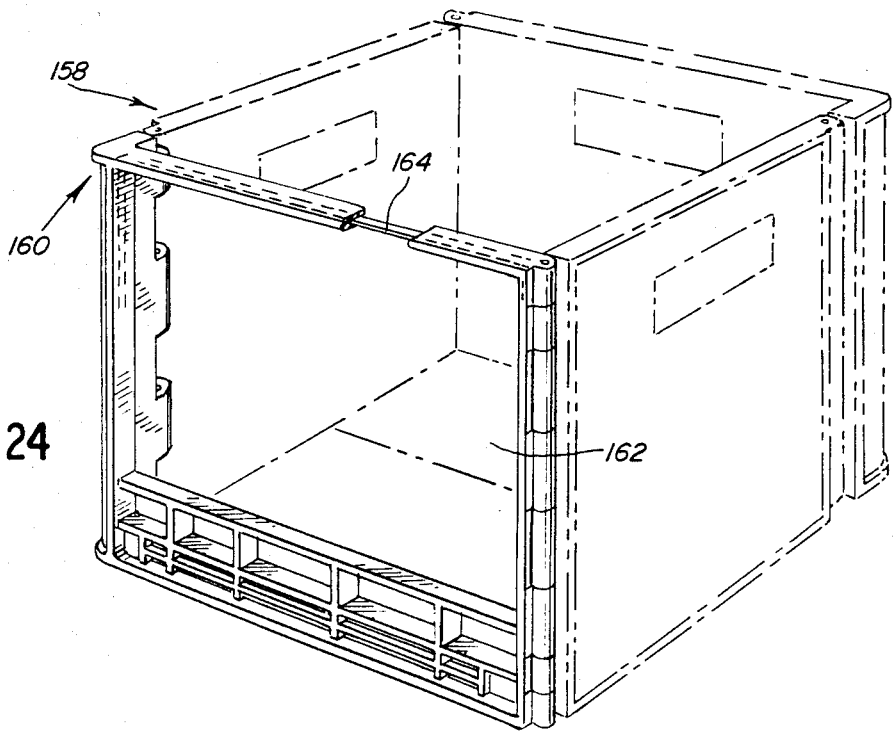
FIG. 24

COLLAPSIBLE CASE

BACKGROUND OF THE INVENTION

1. Field Of The Invention

The subject invention relates to an improved collapsible case which is primarily adapted for holding packaged liquid dairy products. The distribution of milk and milk products has developed into a standardized form wherein most milk and milk products are packaged in some form of paper or plastic container. The containers with the milk and milk products are generally square and cases for these milk products have become standardized in that the cases are designed to hold either; 16 quart containers, 9½ gallon containers, or 4 one gallon containers. The dairy industry has settled upon these cases as being of a convenient size for handling. Many dairies are equipped with automatic machinery for handling of the cases, as well as loading the product into the cases.

In the typical operation of a dairy, the cases are first cleaned off usually with a scalding water to substantially eliminate bacteria which may be on the case. The case is then filled with packaged milk products, and the case with the product is delivered to a vehicle. The vehicle delivers the case with the product to a retail store. The retail store takes control of the case with a packaged product and places the packaged milk products in a display case to offer it for sale to the consuming public.

Once a case has been emptied it becomes a problem for the retail store. The case takes up a substantial amount of room which is generally at a premium in a modern grocery store, such as, a supermarket. Typically, the cases are placed on the outside of the store along a loading area so that when the dairy makes its next delivery, the cases from the previous delivery are retrieved. It may be appreciated that the cases are under the control of the retail establishment, but the retail establishment has no economic interest in the cases. As a result, a certain segment of the public converts the cases to their personal use. This conversion includes utilization of cases as laundry baskets, toy containers, blocks for raising an automobile, or even blocks for supporting planks for tradesmen, such as, painters and wall paper hangers. It follows that dairies suffer a loss of cases which cost is passed onto the consumer in a higher price of milk and other milk products. It is therefore desirable to provide a collapsible case which is particularly adapted for holding packaged milk products, which collapsible case may be stored in a minimum area, but is light-weight, strong and may be readily handled in existing machines which load cases with milk containers.

2. Description Of The Prior Art

The utilization of collapsible containers is known in that U.S. Pat. No. 3,164,281 to A. R. Williams, Jr., entitled, "Collapsible Container", teaches a collapsible container construction. The Williams collapsible container has a pair of floors which are raised and which floors are stored in an indentation in a side wall to allow the container to collapse. It is readily apparent that the use of an indentation requires additional material to make the Williams device heavier than necessary.

U.S. Pat. No. 2,235,093, to F. E. Warnick, issued Mar. 18, 1941, entitled "Collapsible Box" discloses a box construction wherein a pair of complimentary sections of a bottom extend in opposite directions. The construction does not teach a light-weight square container of the type which is required for a collapsible case for use with a modern dairy equipment.

SUMMARY OF THE INVENTION

The instant invention relates to an improved construction for a collapsible square case having a square open top. The case is adapted for holding a plurality of items. The case includes a pair of opposed corner panels and a pair of opposed flat panels. Each of the corner panels has a flat side and a corner wall formed integral with one edge of the flat side. Each corner wall extends substantially perpendicular to its respective flat side. Each corner panel is an integral molded plastic panel. The flat sides are parallel to each other and the corner walls are also parallel to each other. Each of the flat panels has one edge hingedly connected to a corner wall and the opposite edge connected to the flat side of the other corner panel. Each of the flat panels is an integral molded panel. A floor panel is also a molded integral plastic panel. The floor panel is hingedly connected to the lower edge of the flat side of one of the corner panels. When the floor panel is raised, the floor panel allows the case to collapse with the floor panel adjacent to its respective flat side and the hingedly connected flat panels are placed in an attitude whereby each flat panel is substantially in the same plane as the respective flat side. The collapsed case may be stacked on top of a like adjacent collapsed case.

BRIEF DESCRIPTION OF THE DRAWINGS

FIG. 1 is a perspective view of a plurality of collapsible cases each embodying the present invention showing the interrelationship of the cases for stacking one case on top of the other;

FIG. 2 is a perspective view of one of the collapsible cases shown in FIG. 1 in a partially collapsed attitude;

FIG. 3 is a perspective view of the collapsible case shown in FIG. 2, but shown a fully collapsed attitude;

FIG. 4 is a perspective view showing three fully collapsed cases, such as those of FIG. 1 shown in a stacked attitude;

FIG. 5 is an enlarged fragmentary cross sectional view taken on line 5—5 of FIG. 1 showing the interrelationship of the cases when they are stacked;

FIG. 11 is an elevational view of a flat panel which consists a portion of the subject collapsible case;

FIG. 12 is a cross sectional view taken on line 12—12 of FIG. 11;

FIG. 13 is a top view of the flat panel shown in FIG. 11;

FIG. 14 is a top view of one of the collapsible cases of FIG. 1 showing the interconnection to a portion of another collapsible case;

FIG. 15 is a cross sectional view taken on line 15—15 of FIG. 14 showing a floor lock;

FIG. 16 is a cross sectional view of one of the collapsibile cases of FIG. 1 showing a pair of floor panels in a partially raised attitude in dotted form;

FIG. 17 is a side elevational view of a fragmentary portion of a pair of corner panels stacked upon each other with a portion of the panels broken away in order to show a stacking lock;

FIG. 18 is a cross sectional view taken on line 18—18 of FIG. 17;

FIG. 19 is an enlarged fragmentary cross sectional view taken on line 19—19 of FIG. 18;

FIG. 20 is an enlarged fragmentary cross sectional view taken on line 20—20 of FIG. 16;

FIG. 23 is a cross sectional view similar to FIG. 16 but showing a single panel as a floor panel with the floor panel in a partially raised attitude in dotted form; and FIG. 24 is a perspective view with portions shown in dotted form showing a modified form of a corner panel with an enlarged aperture on one side of the corner panel to allow products to be withdrawn from the case through the enlarged aperture.

DESCRIPTION OF THE PREFERRED EMBODIMENT

Figure 6:
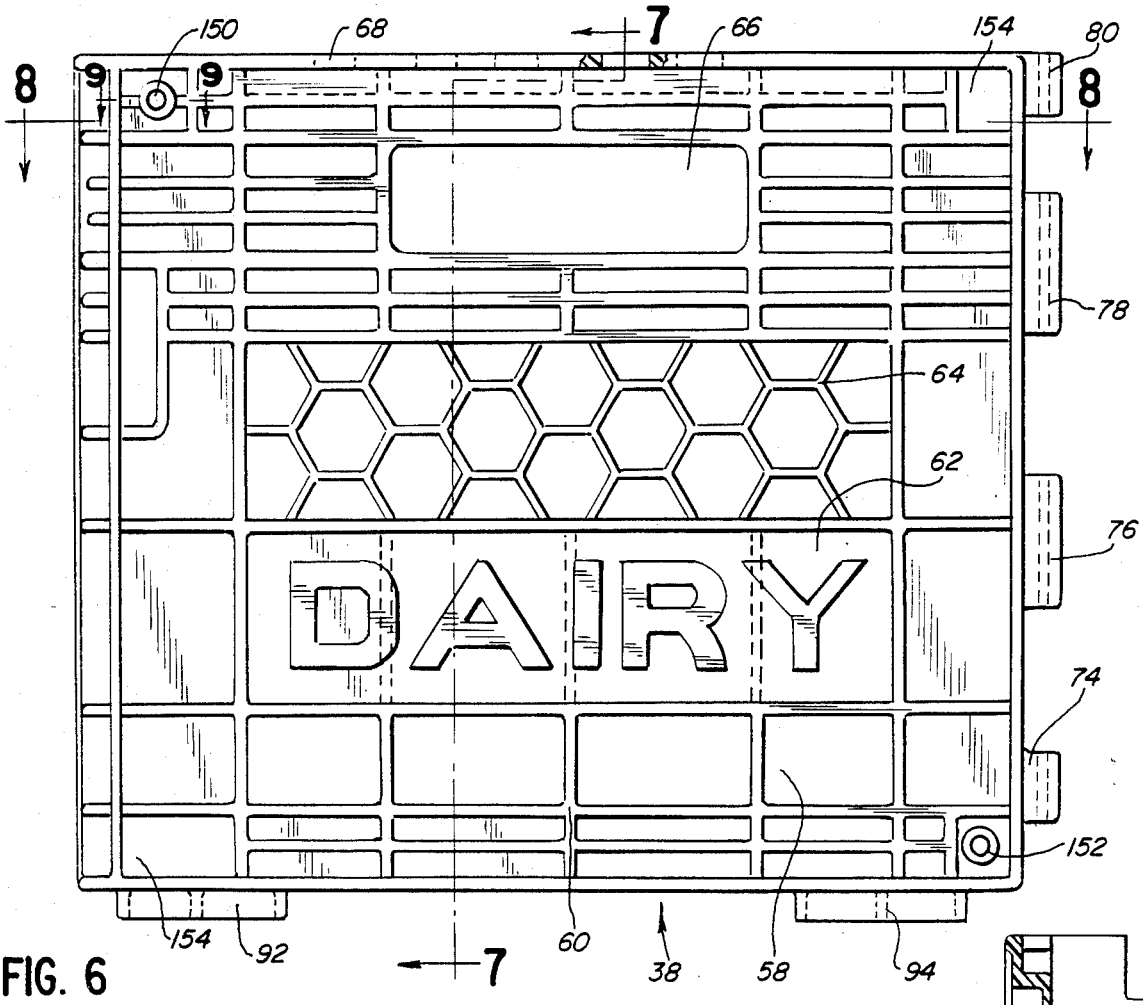
FIG. 6 is an end elevational view showing a corner panel of a collapsible case embodying the herein disclosed invention.
Figure 9:
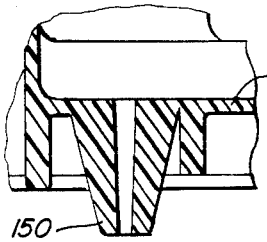
FIG. 9 is a cross section view taken on line 9—9 of FIG. 6 showing a post of a stabilizing lock.

Referring now to the drawings and especially to FIG. 1, four collapsible cases 30, 32, 34, and 36 are shown therein. Case 32 is shown stacked on top of case 34. Case 36 which is shown in fragmentary form is positioned adjacent to case 34, and case 30 is shown in a position for being stacked on top of case 32. The construction of the cases is identical and only one case, to wit, case 34, will be described in detail herein.

Case 34 which is shown in a partially collapsed attitude in FIG. 2 includes a pair of corner panels 38 and 40. A flat panel 42 has opposed edges hingedly connected to panels 38 and 40. A second flat panel 44 has its opposed edges hingedly connected to panels 38 and 40. A floor 46 shown in dotted form is hingedly connected to corner panels 38 and 40. Each of the panels includes a stacking lock 48 for holding the stacked panels. A stabilizing lock 50 is formed on the corner panels. The flat panels contain floor lock 52 which may be best seen in FIG. 15.

Looking now to FIGS. 6 through 9, the construction of corner panel 38 is shown therein. The corner panel generally includes a flat side 54 with a corner wall 56 formed integral therewith. The corner wall 56 is substantially perpendicular to the flat side. The flat side includes a base wall 58 with a plurality of conventional strengthening ribs 60 formed thereon. The wall, in this instance, includes an identification plate 62 formed therein. In this instance, the identification plate is shown with the word "Dairy" embossed on the identification plate. It may be appreciated that any form may be used for applying a name to the identification plate. The name of a dairy may even be stenciled or silk screened on to the identification plate. The flat side has, a sight panel 64 with a honeycomb design grill for retaining the product. The sight panel allows the product to be visible through the sight panel so that it may be determined what is contained in each of the cases when the cases are stacked. A handle aperture 66 is formed in the flat side. The panel has an upper edge 68 formed integral therewith. A pair of hinge ears 70 and 72 is formed integral with the bottom of the flat side. A plurality of side hinge ears 74, 76, 78 and 80 is formed integral with one vertical side of the flat side.

Corner wall 56 has a plurality of corner hinge ears 82 and 84, 86 and 88 formed integral with the free vertical edge of the corner wall. A hook aperture 90 is formed in the corner wall. The corner panel has a pair of feet 92 and 94 on the lower edge of the flat side.

Looking now to FIGS. 11, 12 and 13, flat panel 44 is shown therein. The flat panel is similar in construction to the flat side 54 in that it includes a base wall 96 with a plurality of stregthening ribs 98. An identification panel 100 is formed therein with a sight panel 102 and a honeycomb grill therein, above the identification panel. A handle aperture 104 is formed in the base wall. A lower edge 106 is formed integral with base 96. Flat panel also includes a top edge 108.

The flat panel includes a plurality of ears 110, 112, and 114 on one edge. A second plurality of ears 116, 118, 120 and 122 are formed on the other edge. Ears 110, 112, and 114 are positioned between ears 74, 76, 78 and 80 of the corner panel, while ears 82, 84, 86 and 88 are positionable between ears 116, 118, 120 and 122. The interpositioning of the ears provides for a hinged construction by inserting a hinge pin 124 through each of the sets of ears.

Floor 46 may be best seen in FIGS. 14, 15 and 16. Floor 46 includes a pair of floor panels 126 and 128. The floor panels include an open reinforced design wherein an open reinforced rib structure 130 is the top surface of the panel, while a reinforced diamond construction 132 is the contacting bottom structure to reduce the weight, but maintain maximum strength. Each of the floor panels includes a hinge cylinder 134 which is positioned between the hinge ears 70 and 72 of the corner panel. A floor pin 136 is mounted in the cylinder and ears 70 and 72 to provide a hinged joint between each floor panel and its respective corner panel.

The floor lock is a resilient tab 138 which includes head 140. The resilient tab 138 is formed integral with the respective flat panel and is engagable with the floor panel. As may be seen in FIG. 15, the floor lock resiliently holds the floor panel in an attitude wherein the floor panel is substantially perpendicular to its respective corner panel. Each flat panel has a pair of floor locks with a wall 142 positioned between the floor locks.

Stacking lock 48 includes a stacking indentation 144 positioned in the top edge of each flat and corner panel, as may be best seen in FIG. 14. Each indentation is positioned the same relative distance from the same relative corner of the case. It is to be noted that the length of each flat side is equal to the length of each flat panel and corner wall so that the case has a square opening and each indentation is in the same relative position.

Looking now to FIG. 11, a protuberance 146 is formed integral with the lower edge of the flat panel, and a stacking ridge 148 extends downward from ledge 106. The stacking ridge extends along substantially the entire length of the flat panel and is positioned adjacent to protuberance 146. The protuberance is so positioned that the protuberance of a flat panel may be positioned in any one of the indentations 144. The stacking ridge also serves to hold one case on top of the other. By the utilization of the stacking lock, a manufacturer of the collapsible case can customize the cases for a given dairy, that is, he may place the protuberance and indentations in one relative position along the panels for one dairy, and another position for another dairy, so that the cases of one dairy do not stack on top of the cases of another dairy.

Figure 7:
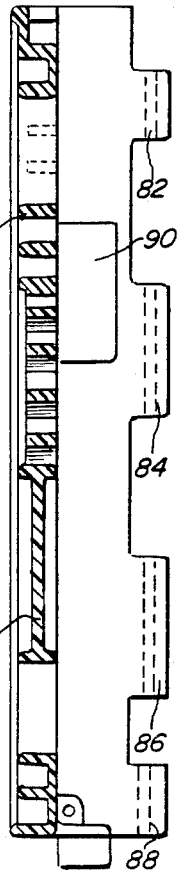
FIG. 7 is a cross sectional view taken on line 7—7 of FIG. 6.
Figure 8:
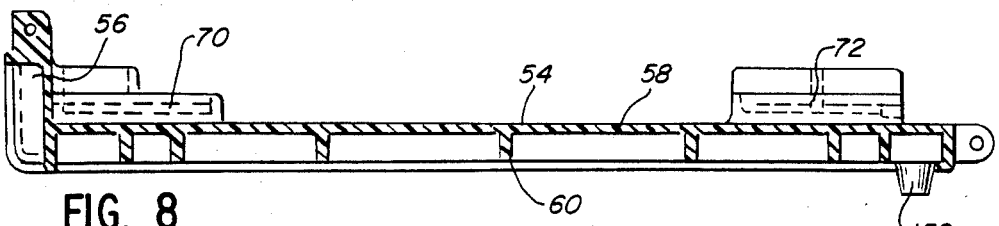
FIG. 8 is a cross sectional view taken on line 8—8 of FIG. 6.
Figure 10:
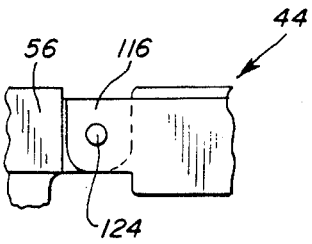
FIG. 10 is a fragmentary end elevational view of a hinge of the subject collapsible case.
Figure 21:
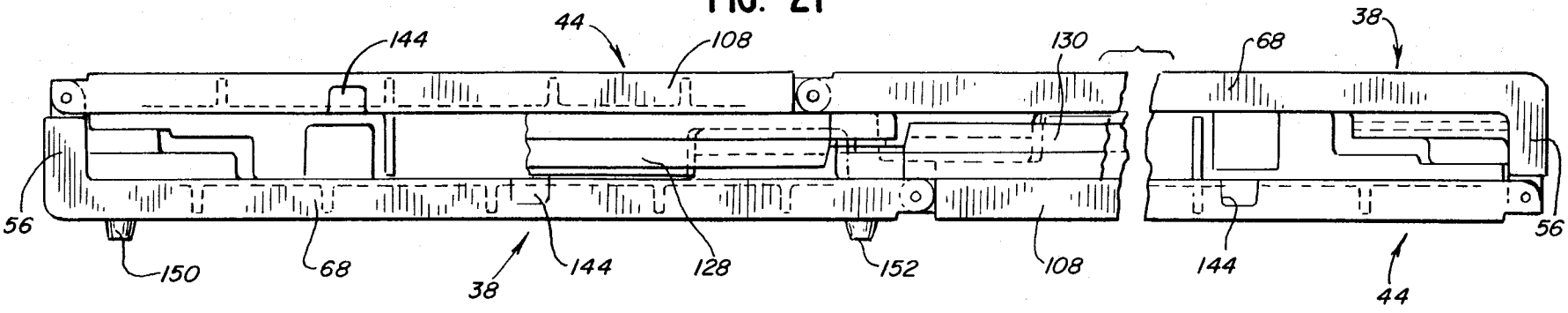
FIG. 21 is a fragmentary top view of the subject collapsible case showin in a collapsed attitude.
Figure 22:
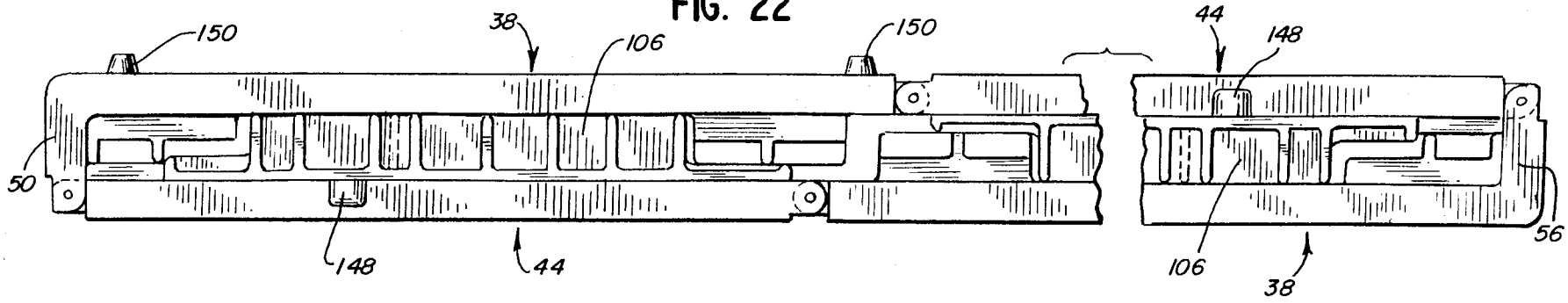
FIG. 22 is a fragmentary plane view of the bottom of the collapsible case shown in a collapsed attitude.

Stabilizing lock 50 includes a pair of posts 150 and 152, which may be best seen in FIGS. 6 and 7. Post 150 is formed in one corner of flat panel 54, while post 152 is formed in the diametrically opposite corner. Flat side 56 has a pair of post receptacles 154. Each flat panel has four post receptacles 154 in each of the four corners. Corner panel 40 has no posts, but contains four post receptacles 154 in each of the corners of its flat side for receiving posts 150 and 152.

Looking now to FIG. 14 which shows a corner panel adjacent to another corner panel with posts 150 and 152 positioned in the post receptacle, it may be seen how positioning of one case next to another case allows the cases to interlock and thereby improve the stability of adjacent stacks of cases. Furthermore, it is to be noted that once the cases are collapsed, the utilization of the posts allows the collapsed cases to be stacked and the cases are not likely to slip or tip over.

From the foregoing description, it may be readily appreciated that the basic component parts of the collapsible case are made as integral molded plastic parts. The parts are made of any suitable molding material, such as, polyethylene; however, any other suitable material may be utilized. The material must be capable of withstanding high temperature during cleaning and high impact in cold weather as well as abrasion by being dragged on a concrete or other coarse surface.

In the operation of the subject collapsible case, the cases are typically delivered to a dairy in a collapsed and stacked condition. The cases are opened by any suitable means, and the floor panels then fall into place and are locked. The cases are cleaned and after cleaning are loaded with suitable product. The cases are stacked on top of one another in much the same maner as that shown in FIG. 1. As was pointed out above, the stacking lock also provides a security, in that cases of one dairy may be kept from being utilized by another dairy. The cases filled with product are delivered to a retail establishment wherein the product may be placed in a cooler in the cases or the product may be taken directly to a display case to be vended to the public. In moving the stacked cases, it is typical to use a hook for pulling the cases. The instant case includes an aperture 90 to provide a means for handling the cases. Once the case has been emptied, the cases are then collapsed by raising the floor panels and collapsing the case. It is to be noted that the width of the corner wall is equal to the thickness of the two floor panels so that they may overlap and allow the flat panel and the flat side to lay in a flat panel, thereby allowing the collapsed cases to stack as shown in FIG. 4. The utilization of the posts and receptacles requires the cases to be stacked in a prescribed manner so that they may be easily utilized in a dairy operation. The stacked cases do not require the room which is required for open cases so that the stacked cases may be stored indoors where the likelihood of pilferage is substantially reduced, thereby reflecting substantial savings to a dairy.

Looking now to FIG. 23, a collapsible case 154 is shown therein. Case 154 is substantially identical to case 34, but rather case 154 has a single floor panel 156 which is secured to floor panel 126 and is hingedly connected to corner panel 38. The utilization of a single floor panel rather than the two floor panels described above may be more desirable in certain applications. It is readily apparent how the single floor panel may be utilized with the existing corner panels and side panels.

FIG. 24 discloses a collapsible case 158, including an aperture corner panel 160. Corner panel 160 is substantially identical to panel 140, but has an enlarged product aperture 162 in a side panel. The enlarged product aperture 162 allows for withdrawal of a product through the aperture so that products may be withdrawn from stacked cases or a case may be placed directly unto a diary display case and the purchaser simply removes the product from the case through the product aperture. The corner panel includes a modification in that the corner panel includes a reinforcement 164 in the interior of the material defining aperture 162 to provide additional strength. The remainder of the operation of case 158 is the same as case 34 described in detail above. Although a specific embodiment of the herein disclosed invention has been described in detail above and shown in detail in the accompanying drawings, it is readily apparent that those skilled in the art may make various modifications and changes without departing from the spirit and scope of the present invention. It is to be expressly understood that the instant invention is limited only by the appended claims.

What is claimed is:

1. A collapsible square case having a square open top particularly adapted for holding a plurality of items comprising, in combination, a pair of opposed corner panels, each of said corner panels having a flat side and a corner wall formed integral with one edge of the respective flat side and extending substantially perpendicular to the respective flat side, each of said corner panels being an integral molded plastic part, said flat sides being parallel to each other, said corner walls being parallel to each other, a pair of flat panels, each of said flat panels having one edge hingedly connected to a corner wall and the opposite edge of the flat panel connected to the flat side of the other corner panel, each of the flat panels being an integral molded plastic part, and a floor panel being an integral molded plastic part, said floor panel being hingedly connected to a lower edge of flat side of one of the corner panels, whereby the panels may be subjected to high temperature heat and moisture for cleaning the panels, and raising of the floor panel allows the case to collapse with the floor panel adjacent to its respective flat side and the hingedly connected flat panels placed in an attitude whereby each flat panel is in substantially the same plane as the respective flat side, a collapsed case may be stacked on top of another collapsed like case, a pair of posts formed integral with a flat side of one of the corner side panels, each of said posts being substantially perpendicular to the flat side, the flat side of the other corner side panel having a plurality of receptacles for receiving the posts, each of the flat panels having a receptacle for receiving a post, whereby a pair of like cases being opened and placed adjacent to each other allow the posts of one case to fit into the receptacles of the other case for stabilizing the positioning of the cases, and when the cases are collapsed and the cases are stacked in a collapsed attitude, the posts mate with the receptacles to stabilize the stack.

2. A collapsible square case having a square open top particularly adapted for holding a plurality of items as defined in claim 1 including, an indentation in the upper edge of each of said side panels and corner side panels, each indentation in each corner panel being positioned from the juncture of the flat side and the corner wall an equal distance as in the other corner panel, each indentation in each flat panel being positioned a distance from the indentation to the juncture between the side panel and the flat side of the corner panel as the distance from the indentation in each flat side to the juncture between the respective corner wall and the flat side, a downwardly extending protuberance on its lower edge of a selected panel mateably with an indentation in the upper edge of a like panel in a like case, whereby the protuberances are also mateable with the indentations in the other panels of a like case to allow stacking of like cases and having the stacked cases interlocked.

3. A collapsible square case having a square open top particularly adapted for holding a plurality of items as defined in claim 1, wherein the floor includes two floor panels, each of the floor panels has one edge hingedly connected to a respective flat side, each of the floor panels has a free edge which is positionable adjacent to the free edge of the other floor panel, and a floor lock formed integral with each flat panel engagable with one of the floor panels for releasably holding the floor panel substantially perpendicular to its respective flat side.

4. A collapsible square case having a square open top particularly adapted for holding a plurality of items as defined in claim 1 including; a floor lock formed integral with a flat panel engagable with the floor panel for holding the floor panel substantially perpendicular to its respective flat side, an indentation in the upper edge of each of the flat panels and each of the corner panels, each indentation in each corner side panel being in the flat side and positioned a given distance from the junction of the flat side and the corner wall, each indentation in each flat panel being positioned a distance from that indentation to the hinged connection between the flat panel and the flat side of the corner panel equal to the distance from the indentation in the flat side to the junction between the corner wall and the flat side, a downwardly extending protuberance formed integral with the lower edge of a panel mateable with an indentation in the upper edge of a like panel in a like case.

5. A collapsible square case having a square open top particularly adapted for holding a plurality of items as defined in claim 1 including, two floor panels, each of the floor panels has one edge hingedly connected to a respective flat side, each of said floor panels has a free edge which is positionable adjacent to the free edge of the other floor panel, and including; a stacking lock formed integral with the corner panels and the flat panels for releasably holding one case in an open attitude to another like case in an open attitude stacked on top of the one case, and a floor lock formed integral with each of the flat panels engageable with the respective floor panel releasably holding the floor panel substantially perpendicular to its respective flat side.

6. A collapsible square case having a square open top particularly adapted for holding a plurality of items as defined in claim 1 including, two floor panels, each of the floor panels has one edge hingedly connected to a respective flat side, each of said floor panels has a free edge which is positionable adjacent to the free edge of the other floor panel, a floor lock formed integral with each of the flat panels engagable with a respective floor panel for releasably holding the floor panels substantially perpendicular to the respective flat sides, each of said flat panels having a floor ledge engagable with the floor panels for holding the floor panels in one direction, an indentation in the upper edge of each of said flat panels and each corner panels, each indentation in each corner side panel being in the flat side and being positioned a given distance from the junction of the flat side and the corner wall, each indentation in each flat panel being positioned from the junction between the flat panel and the flat side of the corner panel a distance equal to the distance from the indentation in each flat side to the junction between the corner wall and the flat side, a protuberance formed integral with the lower edge of a panel and extending downwardly being mateable with an indentation in the upper edge of a like panel in a like case, whereby the protuberance mate with the indentation in the other panel of a like case to allow stacking of like cases and having the stacked cases interlocked.

7. A collapsible square case having a square open top particularly adapted for holding a plurality of items comprising, in combination, a pair of opposed corner panels, each of said corner panels having a flat side and a corner wall formed integral with one edge of the respective flat side and extending substantially perpendicular to the respective flat side, each of said corner panels being an integral molded plastic part, said flat sides being parallel to each other, said corner walls being parallel to each other, a pair of flat panels, each of said flat panels having one edge hingedly connected to a corner wall and the opposite edge of the flat panel connected to the flat side of the other corner panel, each of the flat panels being an integral molded plastic part, and a floor panel being an integral molded plastic part, said floor panel being hingedly connected to a lower edge of flat side of one of the corner panels, whereby the panels may be subjected to high temperature heat and moisture for cleaning the panels, and raising of the floor panel allows the case to collapse with the floor panel adjacent to its respective flat side and the hingedly connected flat panels placed in an attitude whereby each flat panel is in substantially the same plane as the respective flat side, a collapsed case may be stacked on top of another collapsed like case, and a floor lock formed integral with a flat side panel for engagement with a portion of the floor panel for holding the floor panel between the floor lock and a portion of the flat side in an attitude substantially perpendicular to its respective flat side.

* * * * *